US005945076A

United States Patent [19]

Leonard et al.

[11] Patent Number: 5,945,076

[45] Date of Patent: Aug. 31, 1999

[54] COMBINED BRUSH AND STORAGE CONTAINER/DISINFECTING SYSTEM

[75] Inventors: Stephen B. Leonard, Franksville, Wis.; Gary F. Prokop; William A. Lee, both of Wheaton, Ill.; Donald J. Musiel, Racine, Wis.

[73] Assignee: S. C. Johnson & Son, Inc., Racine, Wis.

[21] Appl. No.: 08/966,048

[22] Filed: Nov. 7, 1997

[51] Int. Cl.[6] ..... A61L 2/00

[52] U.S. Cl. ..... 422/300; 15/257.01; 134/184; 222/93; 222/207; 222/633; 401/123; 401/129; 422/294; 422/301

[58] Field of Search ..... 422/300, 292, 422/294, 301; 15/257.01; 206/209, 361, 15.3; 401/123, 125, 127, 129; 222/93–96, 150, 191, 633, 207; 134/184

[56] References Cited

U.S. PATENT DOCUMENTS

| | | | |
|---|---|---|---|
| 650,302 | 5/1900 | Cragin . | |
| 1,193,433 | 8/1916 | Searcy . | |
| 1,200,145 | 10/1916 | Sisti . | |
| 1,687,179 | 10/1928 | Peterson . | |
| 1,943,647 | 1/1934 | Weller . | |
| 2,299,572 | 10/1942 | Estenes . | |
| 2,817,104 | 12/1957 | Hartzell . | |
| 3,185,291 | 5/1965 | Lerner . | |
| 3,190,619 | 6/1965 | Penny et al. . | |
| 3,254,514 | 6/1966 | McCarthy . | |
| 3,868,188 | 2/1975 | Velardi | 401/190 |
| 3,968,789 | 7/1976 | Simoncini | 128/49 |
| 4,001,910 | 1/1977 | Peilet | 15/184 |
| 4,098,434 | 7/1978 | Uhlig . | |
| 4,146,154 | 3/1979 | Mastman . | |
| 4,211,750 | 7/1980 | Gillespie | 422/123 |
| 4,327,056 | 4/1982 | Gaiser | 422/123 |
| 4,620,648 | 11/1986 | Schwartzman . | |
| 4,693,623 | 9/1987 | Schwartzman . | |
| 5,186,563 | 2/1993 | Gebhard et al. | 401/153 |
| 5,320,291 | 6/1994 | Glover et al. . | |
| 5,353,961 | 10/1994 | Debush . | |

*Primary Examiner*—Krisanne Thornton

[57] ABSTRACT

Disclosed herein is a combined toilet bowl cleaning brush and storage container system. The brush is provided with a support which rests on an upper edge of a container wherein the container forms upper and lower volumes and includes a resilient vertically compressible bellows section. Disinfectant fluid is provided in the lower volume. When the support is forced downward, the bellows compresses and fluid is squirted on the brush. When released, the bellows expands and the brush is suspended above the fluid. A restrictor web can be placed at the throat of the lower volume to discourage refill use of the lower volume.

13 Claims, 5 Drawing Sheets

FIG. 5
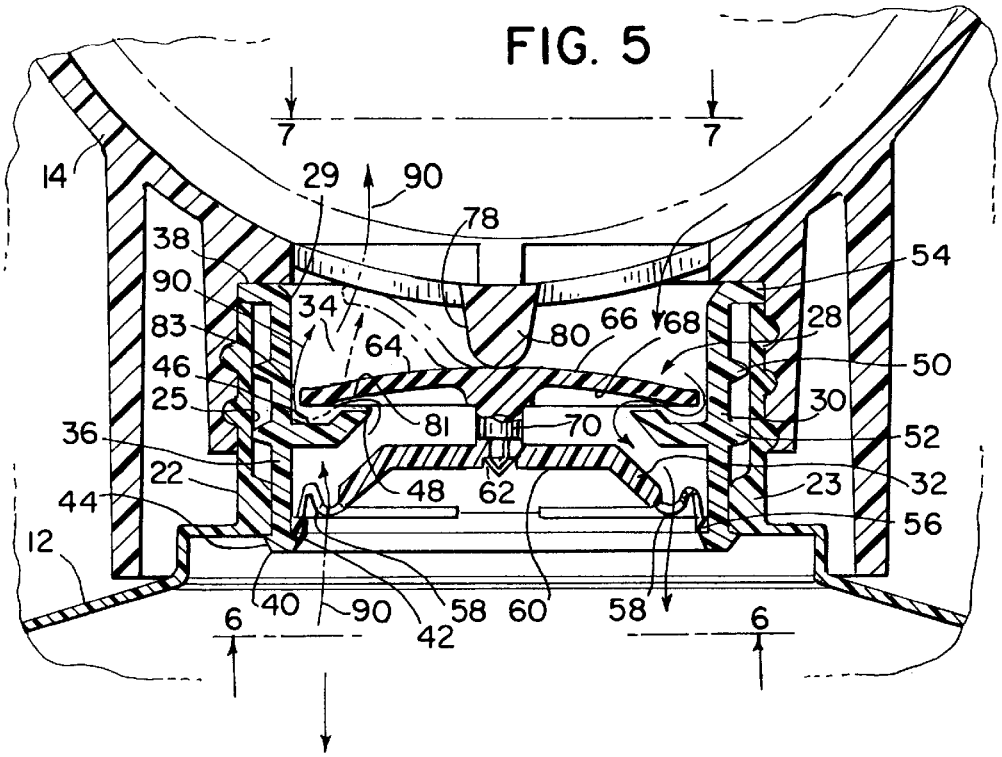
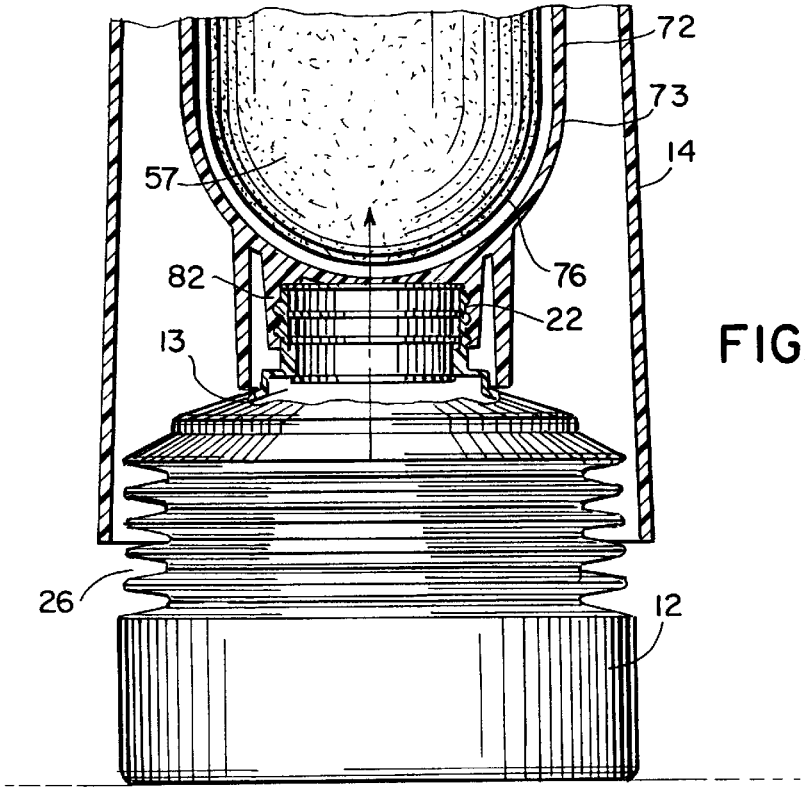
FIG. 4

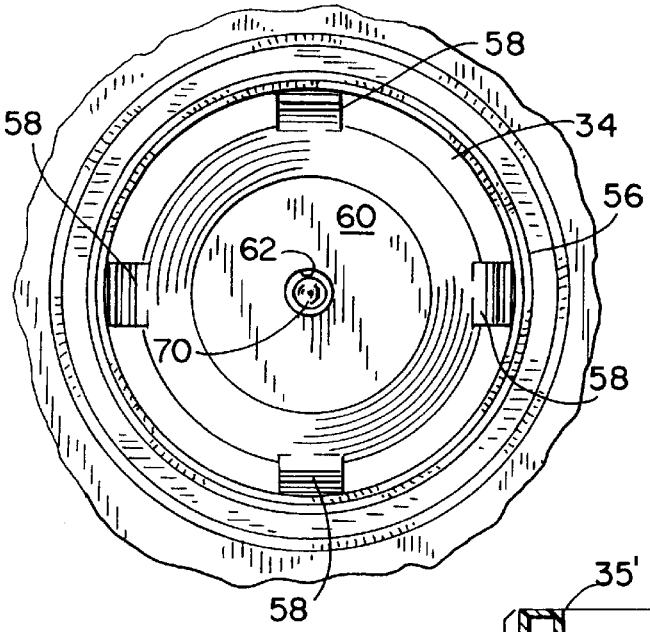
FIG. 6
FIG. 8
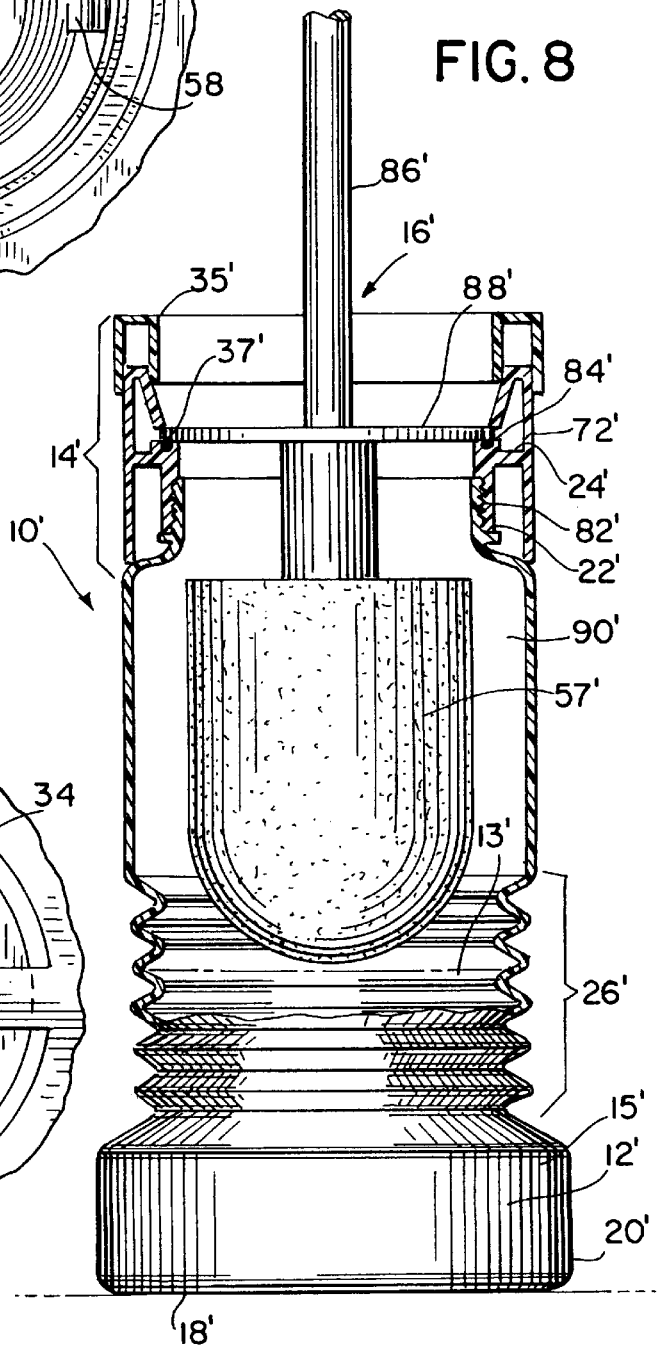
FIG. 7
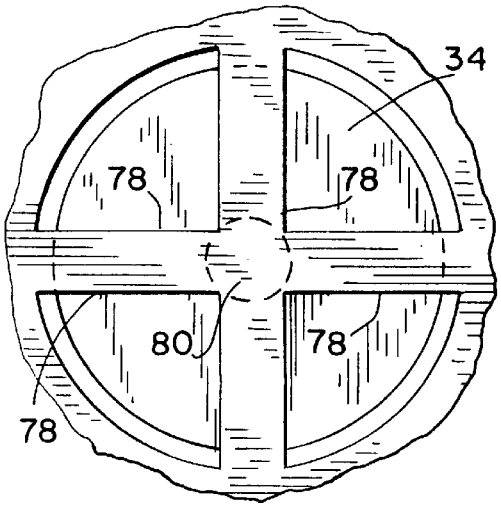

FIG. 9
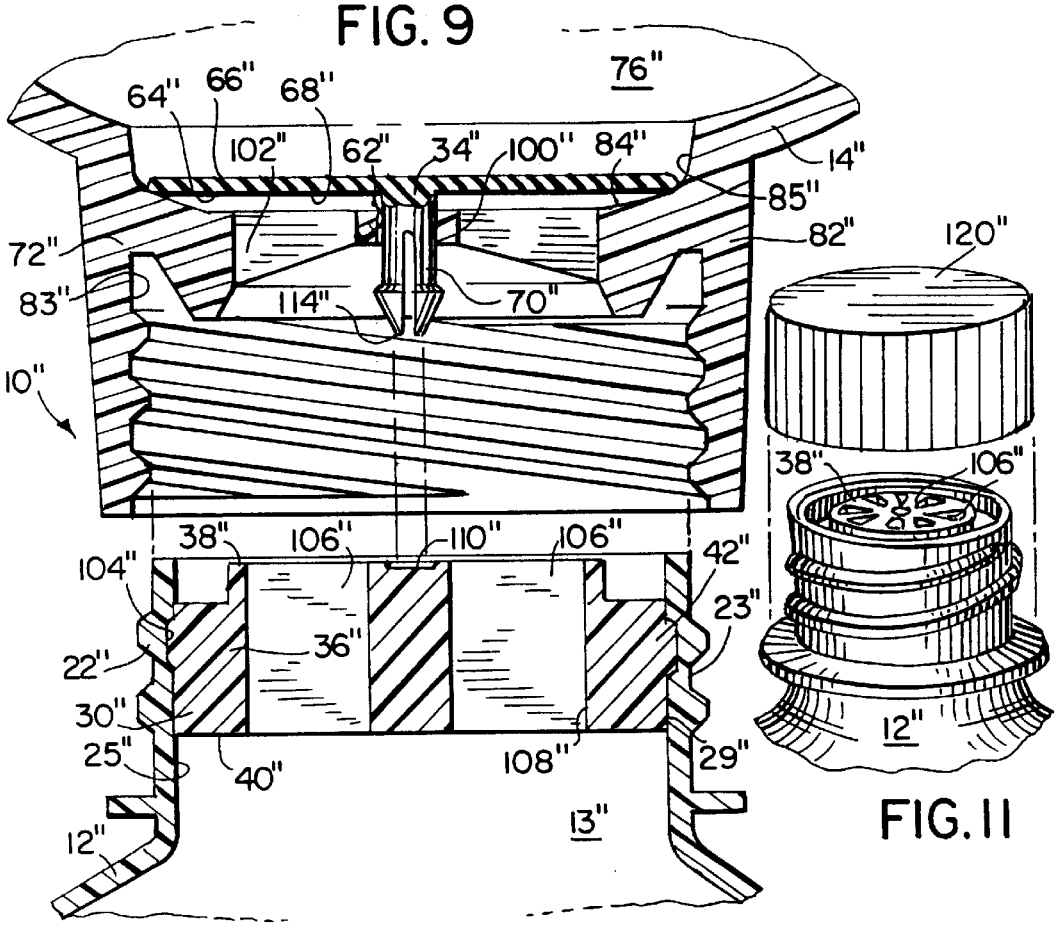
FIG. 11
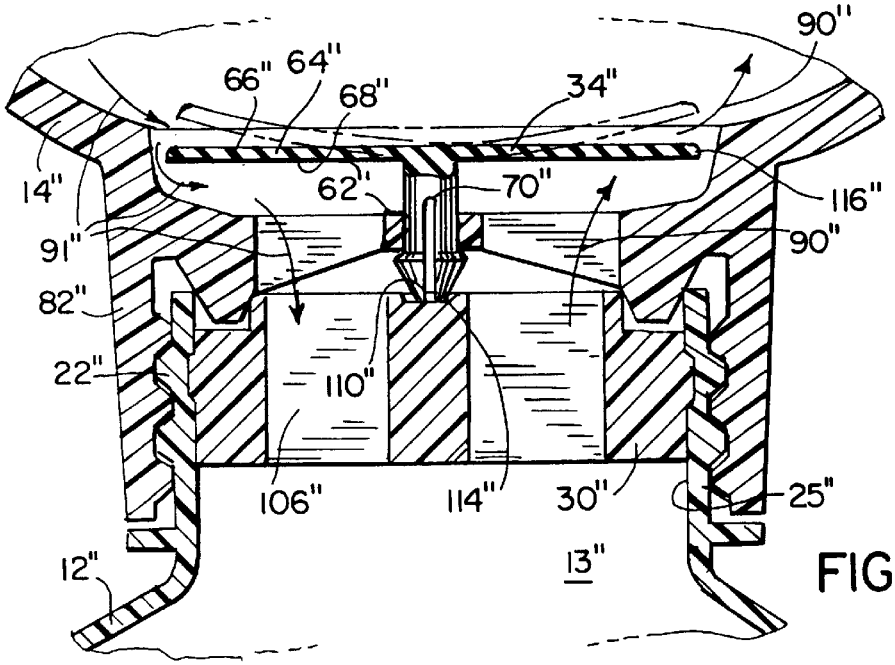
FIG. 10

COMBINED BRUSH AND STORAGE CONTAINER/DISINFECTING SYSTEM

BACKGROUND OF THE INVENTION

This invention relates to toilet bowl cleaning brushes and containers for storing them. More particularly, it relates to a system for disinfecting and drying a brush while storing.

Toilet bowls can become stained due to chemicals present within a water supply or due to residual waste. Many cleaning products for toilet bowls contain chemical formulations which are designed to be applied to such stains with a brush to clean and disinfect the toilet. After use, even after thoroughly rinsing such brushes, there can still be residual waste on the brush (or at least the perception that such waste has not been fully rinsed off).

As such, between uses toilet bowl brushes are often stored "loose" next to the toilet, or in specifically designated containers. Sometimes these containers hold a liquid disinfectant which sanitizes the brushes. However, when stored in a liquid disinfectant, upon removal for subsequent use, the brush is typically still drenched in disinfectant rendering removal a messy procedure (e.g. causing dripping).

In addition, as disinfectant containers are typically reusable, after a store bought disinfectant has been depleted, a user might be tempted to try to concoct a replacement disinfectant solution using available household chemicals (e.g. ammonia, bleach, etc.). Such chemicals might be environmentally unsuitable for use in systems that discharge into sewers. Further, some such concoctions may be harmful to the user or damage plumbing system components.

Therefore, it would be advantageous to have an improved toilet bowl brush storage/cleaning system which disinfects yet facilitates tidy brush removal for subsequent use. In addition, it would be advantageous to have such a system which discourages the use of user concocted disinfectants.

BRIEF SUMMARY OF THE INVENTION

In one aspect the invention provides a combined brush and storage container system. There is a container having a bottom member, a wall extending up from the bottom member to a support edge, the wall having a resilient vertical compressible portion, the floor member and wall together defining a cavity having upper and lower volumes, with the lower volume being suitable to store a fluid. There is a brush is assembly having an upper handle, a support extending below the upper handle (preferably radially extending), and a lower brush portion. With the brush portion inserted in the cavity and the support extension resting on the support edge, downward vertical movement of the support extension compresses the vertical portion and reduces at least one of the upper or lower volumes from an original volume. In this way, at least a portion of the fluid contacts the brush portion. Upon a release of the handle, the container will expand such that the reduced volume increases to the original volume.

In one aspect the vertical portion is a bellows. When the bellows is compressed, the brush portion is emersed in the fluid. After the bellows expands, the brush portion is suspended above the fluid.

In another aspect the upper and lower volumes are separated by a valve such that when the bellows is compressed, a portion of the fluid can be forced past the valve into the upper volume. The valve allows a first flow rate from the lower to the upper volume and a second flow rate from the upper to the lower volume. The second flow rate is less than the first flow rate (depending on the soak rate required to disinfect the brush).

To this end, the valve has an opening between the upper and lower volumes and includes a gasket having top and bottom surfaces. The gasket is mounted over the opening in the volume with the top surface facing the upper volume and the bottom surface facing the lower volume. The gasket impedes the second flow rate to a greater extent than it impedes the first flow rate due to its elastic properties. This allows the brush to soak in the fluid for a predetermined time, and then drip dry.

It will be appreciated from the discussion below that the present invention provides an assembly for storing a toilet bowl brush where the bristles of the brush are immersed in a disinfectant for a short period after use, and then are suspended above the disinfectant prior to a subsequent use. Between uses the bristles drip dry. During a subsequent use the brush can be removed without causing a mess.

In an especially preferred form, the bellows is part of a replaceable/disposable refill bottle having an outwardly threaded upper end. A standard cap can close the bottle when it is sold for refill purposes. When it is to be used with the present system, the cap is removed.

In another aspect the upper volume forms a first throat and a valve seat therein at a lower end and the lower volume forms a second throat at an upper end, the lower volume including a radially inwardly extending member forming a support surface essentially within the second throat. In this aspect the system includes a gasket having a blocker and a supporter, the blocker having upper and lower surfaces, the supporter extending from the lower surface and having a distal end. The gasket is mounted inside the first throat with its top surface facing the upper volume and for movement therein between a blocking position with the blocker on the seat and a valve position above the seat. When the first and second throats are attached, the support surface contacts the distal end and supports the gasket in the valve position.

In one other aspect the member is a first member and the upper volume includes a radially inwardly extending second member having a distal end which receives the support extension, the second member essentially within the second throat.

In another aspect the member is a plurality of members circumferentially arranged around and extending radially inwardly from the wall forming the second throat.

In yet another aspect the supporter extends from and essentially perpendicular to a central section of the lower surface and the support surface is essentially centrally located within the second throat and is essentially co-planar with the upper end of the lower volume.

A primary object of the invention is to provide a storage container for a cleaning brush in which the container is designed to store both the brush and a disinfectant.

Another object is to provide a system of the above kind which facilitates immersion of a brush in a disinfectant solution after use, yet suspends the brush above the solution between uses such that the brush is essentially dry prior to a subsequent use.

Another object of the invention is to provide a system of the above kind which prevents odors from escaping the container.

Yet another object is to provide a brush container which can be used to transport a brush and disinfectant solution.

Another object of the invention is to provide a system of the above kind wherein the throat leading into the lower volume is impeded thus discouraging system refill with user concocted disinfectants and encouraging proper disposal of sullied disinfectant.

Another object of the invention is to provide a system of the above kind which is comprised of few parts, which is inexpensive to produce, and which is easy for a consumer to use.

Still other objects and advantage of the present invention (e.g. methods for using these systems) will become apparent from examination of the specification and claims which follow.

BRIEF DESCRIPTION OF THE DRAWINGS

FIG. 4 is a partial cross-sectional view similar to FIG. 3, albeit in a compressed configuration;

FIG. 5 is an enlarged cross sectional view taken along the line 5—5 of FIG. 3;

FIG. 6 is a cross sectional view taken along the line 6—6 of FIG. 5;

FIG. 7 is a cross sectional view taken along the line 7—7 of FIG. 5;

FIG. 8 is a cross sectional view similar to FIG. 3, albeit of a second embodiment having a unitary bottle configuration;

FIG. 9 is a cross sectional view similar to FIG. 5, albeit of a third embodiment with upper and lower volumes shown not linked to each other;

FIG. 10 is similar to FIG. 9, albeit with attached upper and lower volumes; and FIG. 11 is a partial perspective view of the lower volume throat of FIG. 10 along with a bottle cap.

DETAILED DESCRIPTION OF THE INVENTION

Figure 1:
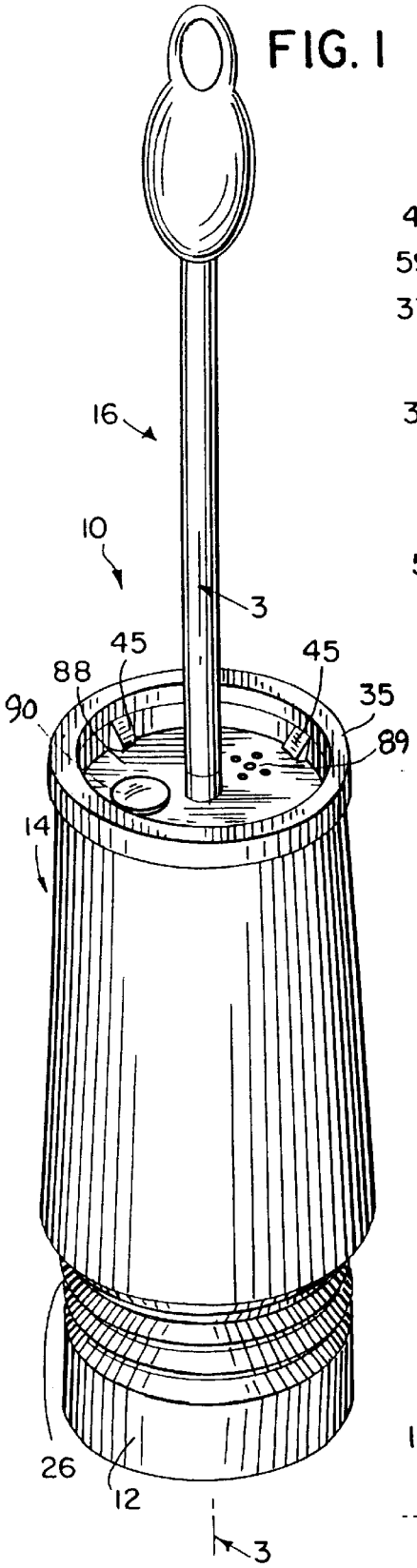
FIG. 1 is perspective view of an embodiment of the present invention.

FIG. 1 shows a first embodiment of the combined brush and storage system of the present invention (generally 10). The system includes four main separate components or assemblies, a disinfectant fluid container or bottle 12, a brush container 14, a brush assembly 16 and a valve 28.

Container 12 is preferably formed of a resilient plastic such as polyethylene or polypropylene and includes a lower floor/bottom member 18 and a generally cylindrical wall 20 extending upwardly therefrom to an upper edge 24. Wall 20 and member 18 together define a lower disinfectant liquid containing volume 13.

Wall 20 includes a base section 15, a bellows section 26 and a connector section 22. Base section 15 is cylindrical and vertically rigid such that it is not vertically compressible under normal conditions. Wall 20 is sized to accommodate the required labeling information for disinfectant formulations.

Bellows section 26 is integrally connected to section 15. Section 26 is resilient and vertically compressible such that, when compressed (compare FIG. 4), volume 13 is reduced. After compression (see FIG. 3), section 26 resiliently expands so that volume 13 returns to its pre-compressed original volume.

Referring also to FIG. 5, connector section 22 is cylindrical and rigid, integrally connected to, and extends vertically upwardly from, bellows section 26. It has a reduced diameter, forms a thread on an external surface and has an internal surface 25 which forms an internally extending flange 23 at a lower end.

Referring to FIGS. 5–7, valve 28 includes a housing 30, a gasket support 32 and a gasket 34. Housing 30 generally includes a cylindrical wall 36 having an upper edge 38, a lower edge 40 and an internal surface 29 and forms a plurality of radially extending circumferential flanges. Housing 30 forms both a radially inwardly extending flange 42 and a similarly shaped radially outwardly extending flange 44.

Approximately mid-way between edges 38 and 44, housing 30 forms a central radially inwardly extending flange 46 which extends upwardly at its distal edge forming a valve opening 48. There are two other equispaced outwardly extending flanges 50, 52, respectively. A radially outwardly extending flange 54 is provided at upper edge 38 which extends further outwardly than flanges 44, 50 or 52.

Housing 30 is sized such that it snap fits snugly within section 22. To this end, an outer diameter of housing 30 taken through flanges 44 should be slightly greater than an inner diameter of section 22 taken through flange 23, outer diameters of housing 30 taken through flanges 50 and 52 should be nearly identical to the diameter of internal surface 25 and outer diameter of housing 30 taken through flange 54 should be greater than the diameter of surface 25 such that flange 54 limits downward movement of housing 30 into container 12.

Support 32 includes a circular ring 56 having a diameter equal to the diameter of the internal surface 29, four radially internally extending leg extensions collectively referred to by the numeral 58, and a gasket support disc 60. Legs 58 are equispaced about ring 56 and extend inwardly and upwardly to disc 60 suspending disc 60 above ring 56. Legs 58 are flexible so as to act like a spring. Support disc 60 can during use of the system abut against surface 48. Disc 60 forms a central aperture 62.

Gasket 34 includes a circular wall member 64 having top and bottom surfaces 66, 68, respectively. Gasket 34 also includes a post 70 which extends downwardly from a central portion of surface 68 and is formed so as to be securely receivable in aperture 62. Gasket 34 is formed of resilient elastomeric material.

Referring again to FIG. 3, assembly 14 includes a brush storage component 72 and a locking ring 35. Component 72 forms a container 73 which defines an upper volume 76 for receiving a brush. Container 73 forms an upper ledge 84 and is rounded, and forms four apertures collectively referred to by numeral 78 at, a bottom end 75 (see FIG. 7). Centrally located between apertures 78, container 73 forms a downwardly extending post 80 (see FIGS. 5 and 7).

A gasket 37 is positioned on ledge 84. Gasket 37 is preferably made of an elastomer or a synthetic sealing material such as resiliently expandable plastic.

A cylindrical connector section 82 circumscribes apertures 78 and extends axially downwardly from container 72. Section 82 is sized and threaded on its internal surface so as to securely and threadably receive connector section 22.

Figure 2:
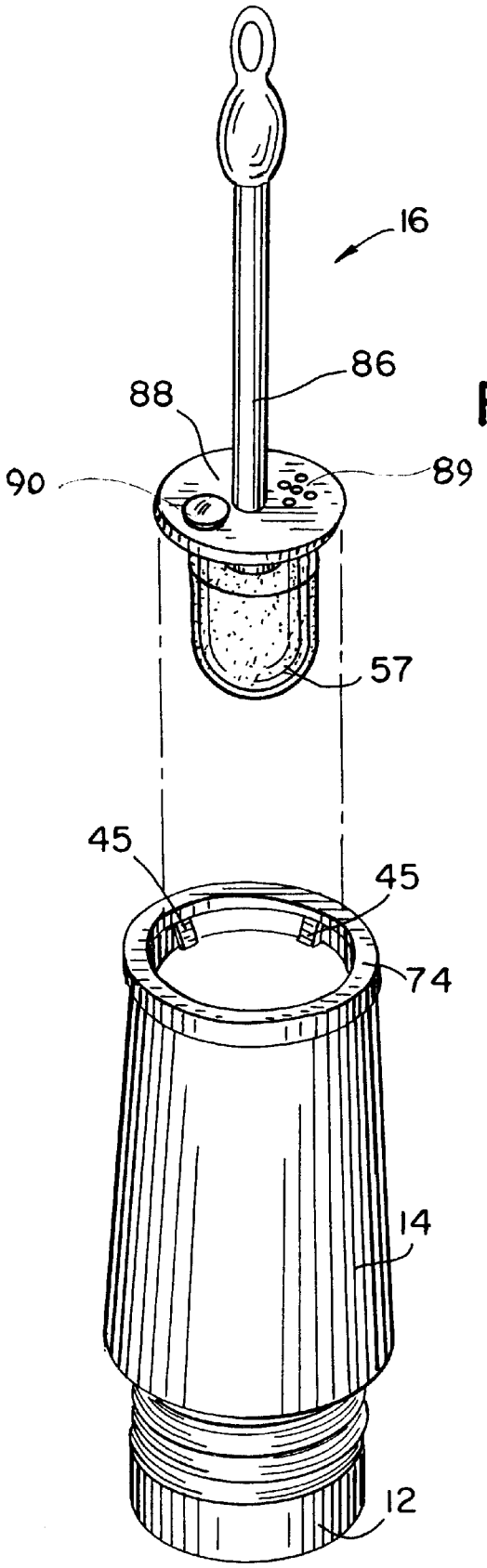
FIG. 2 is an exploded perspective view of the system of FIG. 1.

Component 72 also forms a generally cylindrical skirt 39 having upper and lower ends 41, 43, respectively. At upper end 41, skirt 39 curves radially inwardly and downwardly and is integrally connected at a distal edge to ledge 84. Skirt 39 also includes a plurality of integrally attached latches 45 (at least two, preferably three or four, equispaced around upper end 41) extending inwardly and downwardly toward and above ledge 84 (see especially FIG. 2). Latches 45 are able to flex radially inward and outward.

Key 35 is in the form of a slip ring mounted over upper end 41. Key 35 has a downwardly open cavity 51 and an inner wall 53 which extends downwardly adjacent latches 45. When the key 35 is pushed downwardly a lower portion 55 pushes against latches 45, thereby providing a radially outward force adjacent a clearance area 59.

Brush assembly 16 has a handle portion 86 and a radially extending disc-like support wall 88 which is preferably sized to rest on ledge 84. Flapper valves for air-intake 89 into container 72 and flapper valve for air escape 92 from container 72 are located on support wall 88. Alternatively duck bill valves (not shown), ball check valves (not shown) or other conventional valves may be utilized to intake and evacuate air into the container. There is also a conventional extension and bristle or pad 57. Alternatively, other brushing means can be used.

Figure 3:
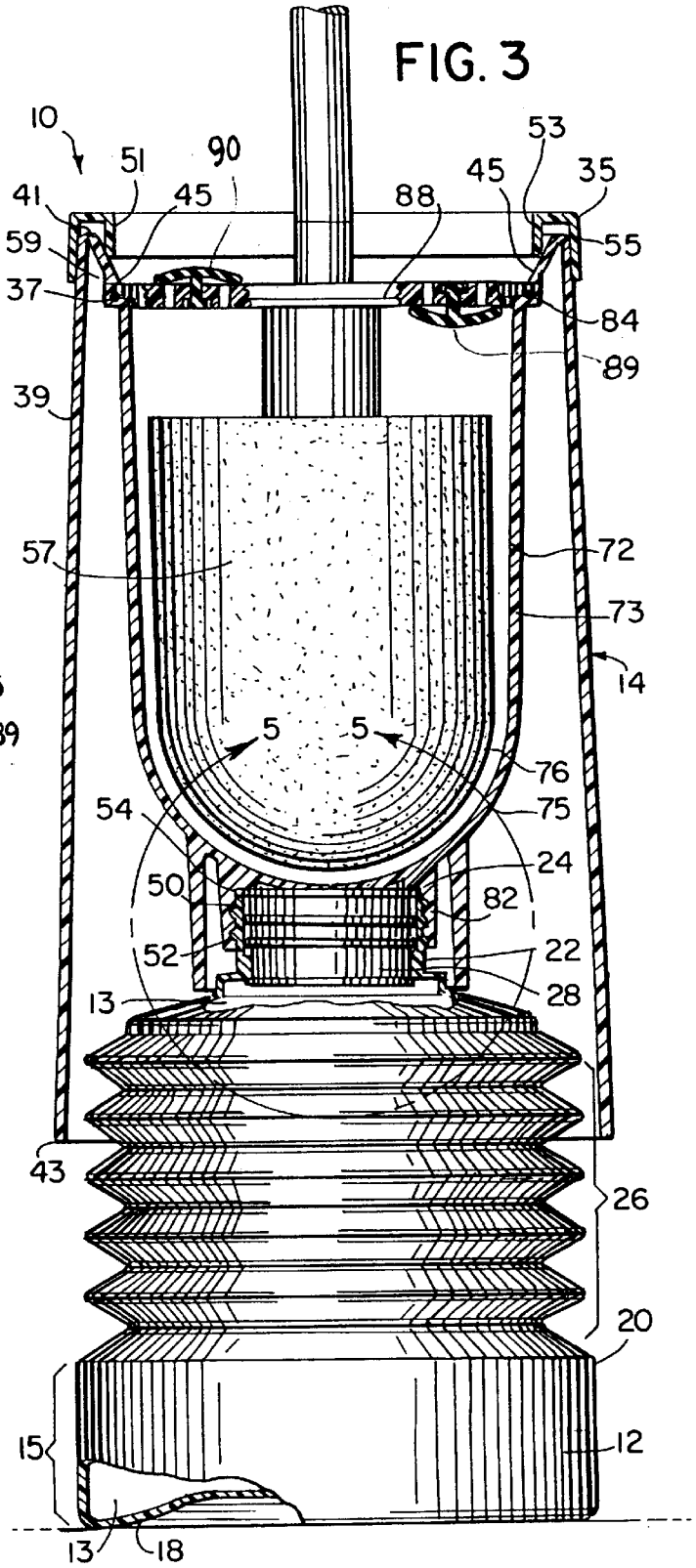
FIG. 3 is a cross-sectional view taken along line 3—3 of FIG. 1, albeit with the lower bottle only partially in section.

When brush 57 is placed inside volume 76 for storage, latches 45 "step on" disk 88 to retain it in place in a sealed fashion. (FIGS. 1 & 3.) However, if a user presses key 35 downwardly, wall 51 drives latches 45 radially outwardly to an unblocking position. Brush 16 can then be removed. Key 35 springs up to its original "ready" position automatically. After use, brush 16 can then be returned by driving the brush down past latches 45. The resiliency of latches 45 will then cause the latches to move radially inward into the blocking or locked position.

Referring again to FIG. 3, disinfectant/cleaning fluid is placed inside volume 13. Numerous known fluids of this type can be used. One such fluid is 0.4% alkyl dimethyl benzyl ammonium chloride, 0.01% of a dye such as Acid Blue, and the remainder water. If desired, a portion of the water can be replaced with a surfactant compatible with the disinfectant to provide 1% non-ionic surfactant (e.g. an ethoxylated alcohol such as L-24-9 from Huntsman). Also, a perfume oil can also be added (e.g. 0.1%).

Other disinfectants may also be used, such as bleach or other known disinfectants that have been approved for toilet related uses.

To assemble the system 10, with disc 60 facing extension 46, support 32 is forced into housing 30 such that ring 56 is inside extension 42 and disc 60 is adjacent opening 48. Next, gasket 34 is placed inside housing 30 such that bottom surface 68 faces disc 60 and post 70 is aligned with aperture 62. Post 70 is forced through aperture 62 so that it is secured thereto. When so assembled, the edges of gasket 64 and the internal surface of wall 36 form a slight gap 83 (see FIG. 5). In addition, post 70 maintains bottom surface 68 above extension 46 such that there is a slight gap 81 therebetween.

Valve 28 is secured inside section 22 by forcing housing 30 down into section 22 such that flange 44 extends below and radially outward of flange 23. With valve 28 inside section 22, section 22 is threadably received inside section 82. (See FIG. 5.) When so connected, the distal end of post 80 should rest on a central portion of top surface 66 just above post 70. This helps maintain gasket 34 in a desired position during operation.

In operation, after brush assembly 16 has been used to clean a toilet or sink, brush 57 is placed inside container 73 with support wall 88 resting on gasket 37. This position can be reached because the wall 88 drives latches 45 outwardly until the wall has passed down below it. Due to the resiliency of the latches 45, they automatically move radially inward to lock assembly 16 in place. (See FIG. 3.) In this position, brush 57 and fluid in volume 13 are completely separated.

To disinfect brush 57, one pushes down on handle 86 causing downward vertical force on ledge 84. Referring particularly to FIG. 4, the force is transmitted through container 72 and section 22 compressing bellows section 26 therebelow. Referring also to FIG. 5, when bellows 26 is compressed fluid in volume 13 is forced up through valve 28 in the direction indicated collectively by arrows 90. Air escapes from container 72 through air escape flapper 92. As fluid is forced into the gasket's lower surface 68, gasket 64 flexes upwardly (see phantom) thus allowing a first flow rate of fluid from lower volume 13 into upper volume 76. Fluid enters volume 76 with force such that it "floods" onto brush 57 effectively immersing brush 57 with fluid.

A fluid will initially accumulate at the bottom of volume 76 and in section 22 above gasket 34. Accumulated fluid above gasket 34 flexes gasket 34 downwardly tending to restrict gap 81 between bottom surface 68 and the distal edge of flange 46. Between uses, brush 57 is suspended above the fluid and eventually dries. When assembly 16 is again removed from container 73 it has been disinfected, is dry and, most importantly can be removed without causing dripping.

Referring now to FIG. 8, a second embodiment 10' of the present invention is illustrated. The second embodiment includes a disinfectant fluid container 12', a brush storage/locking assembly 14' and a brush assembly 16'. Assembly 16' is identical to assembly 16 and therefore will not be explained here in detail. In addition, many of the features of assembly 14' are similar to the features of assembly 14 and therefore, only features which are unique to assembly 14' will be explained. Analogous parts are designated with a prime symbol.

Container 12' includes a floor 18' and a generally cylindrical wall 20' extending upwardly therefrom to an upper support edge 24'. Wall 20' and member 18' together define a cavity including a lower or disinfectant liquid volume 13' and an upper volume 90'.

Wall 20' includes a base section 15', a bellows section 26' and a connector section 22'. Sections 15' and 26' are similar to sections 15 and 26. Connector section 22' is cylindrical and rigid, integrally connected to and extends vertically upwardly from bellows section 26' and forms a thread on an external surface. This embodiment does not include a valve.

Assembly 14' includes a skirt component 72' and a locking ring 35'. Component 72' includes a cylindrical connector section 82' which is sized and threaded on an internal surface such that it threadably receives section 22'. Above section 82' component 72' forms a ledge 84' on which a gasket 37' is positioned. The remainder of component 72' and key 35' are similar to component 72 and key 35.

To assemble system 10', assembly 14' is simply screwed onto container 12' and disinfectant fluid is placed inside volume 13'.

In operation, after assembly 16' has been used, brush 57' is placed inside container 12' with support wall 88' resting on gasket 37'. In this position, brush 57' and fluid in volume 13' are separated, but in the same container.

To disinfect brush 57', one pushes down on handle 86' causing bellows section 26' therebelow to compress. Air escapes from container 72 through flapper valve 92 (not shown). When section 26' is compressed, brush 57' is emersed in disinfectant fluid. Once force is removed from handle 86', bellows 26' again expands and lifts brush 57' out of the fluid suspending brush 57' thereabove, and air enters container 72 through air intake flapper valve 89 (not shown).

In either of the two embodiments above, it is contemplated that containers 12 and 12' will be replaceable/disposable and that assemblies 14, 14', 16 and 16' will be reusable (or alternatively also replaceable). In addition, it is also contemplated that valve 28 may be reusable. Thus, containers 12 and 12' might be sold with disinfectant therein and simply attached to assemblies 14 and 14', respectively. In the alternative, disinfectant within containers 12 or 12' may simply be replaced after a number of uses.

Referring now to FIGS. 9 through 11, a third embodiment 10" of the present invention is illustrated. The third embodiment is similar to the first embodiment except for the connecting sections of the upper and lower volumes. Therefore, only the connecting sections are explained in detail here and analogous parts are designated by a double prime symbol. The third embodiment 10" includes a disinfectant fluid container 12", a brush container 14", and a valve assembly including a gasket 34" and a supporter web 30".

Container 14" forms a brush volume 76" and includes a first throat or cylindrical connector section 82" threaded on an internal surface 83". At a top end of section 82" a radially inwardly extending flange 72" forms a valve seat 84".

Supporter web 30" generally includes a cylindrical wall 36" and a plurality of extension members collectively referred to by numeral 106". Wall 36" has an upper edge 38", a lower edge 40", an external peripheral surface 29" which forms a single radially outwardly extending circumferential flange 42" approximately mid-way between edges 38" and 44" and an internal surface 108". Members 106" are circumferentially equispaced about surface 108", extend radially inwardly therefrom and are connected at their distal ends forming an upwardly facing support surface 110" which is essentially co-planar with edge 38". Together, members 106" form a "web" (see FIG. 11).

Supporter web 30" is sized such that it snap fits snugly within section 22". To this end, an outer diameter of supporter web 30" taken through flange 42" should be slightly less than an inner diameter of section 22" taken through recess 104" and greater than the diameter taken above or below recess 104". Preferably container 12" and supporter web 30" are formed of resilient plastic and therefore supporter web 30" can be forced into section 22" and retained therein.

Gasket 34" includes a circular blocker or wall member 64" having top and bottom surfaces 66", 68", respectively. Member 64" has a diameter which is slightly less than the diameter of container 14" at the throat end. Gasket 34" also includes a post 70" which extends downwardly from a central portion of surface 68". Post 70" is formed so as to be loosely receivable in aperture 62" and is therefore freely and axially moveable within aperture 62" between a blocking position (see FIG. 9) and a valve position (see FIG. 10). Gasket 34" is formed of resilient elastomeric material.

Referring specifically to FIG. 9, to mount gasket 34" inside member 82", post 70" is forced through aperture 62" so that surface 66" faces volume 76" and surface 68" faces volume 13". When so positioned, prior to securing section 82" to section 22", the edge of lower surface 64" rests on seat 84".

To connect container 14" to container 12", with fluid inside volume 13", container 14" is simply screwed onto container 12". Referring to FIG. 10, when so connected, a distal end 114" of post 70" contacts surface 110" and surface 110" forces gasket 34" up off seat 84". When section 64" is lifted from seat 84", a slight gap 116" is formed around the outer circumference of section 64".

In operation, after a brush assembly (not illustrated in FIGS. 9–11) has been used, the brush is placed inside container 12" with the brush and fluid in volume 13" separated. To disinfect the brush, one pushes down on the brush handle causing a bellows section therebelow to compress. When the bellows section compresses, fluid in volume 13" is forced up through supporter web 30" and the openings between members 106" in the direction indicated collectively by arrows 90". As fluid is forced into the gasket's lower surface 68", gasket 64" flexes upwardly (see phantom) thus allowing a first flow rate of fluid from lower volume 13" into container 12". Fluid enters container 12" with force such that it "floods" onto the brush therein effectively immersing the brush with fluid.

A fluid will initially accumulate at the bottom of container 12" and in section 82" above gasket 34". Accumulated fluid above gasket 34" forces gasket 34" into its original position restricting gap 116" between the edge of section 64" and the internal wall of section 82". Because gap 116" is restricted, return flow from container 12" to volume 13" along the direction collectively indicated by arrows 91" is relatively slow and accumulated fluid inside container 12" remains there for a disinfecting period (e.g. five minutes). During the disinfecting period the fluid kills germs on the brush.

When downward force is removed from the handle, the bellows therebelow expands under its own resilient force and again assumes an expanded configuration. Eventually, despite the relatively slow flow back into volume 13", all accumulated fluid in container 12" passes through valve gap 116" and returns to volume 13". Between uses, the brush is suspended above the fluid and eventually dries.

The third embodiment described herein has several advantages over the other two embodiments described. For example, referring again to FIG. 10, container 12" can be removed from container 14" even during a disinfecting period wherein fluid remains in volume 76". This is because, when container 14" is screwed off of container 12", post 70" is no longer supported in the valve position with section 64" above seat 84". Instead, section 64" rests on seat 84" and seals throat section 82". In this manner, container 12" can be replaced at any time without causing a mess (e.g. spillage).

In addition, referring to FIG. 11, after container 14" is removed from container 12" for replacement, a screw cap 120" can be provided to cover container 12" and facilitate proper disposal. Moreover, the web formed by members 106" discourages refill and encourages proper disinfectant disposal by making disinfectant discharge and refilling a tedious and time consuming process. To this end, the web only allows relatively slow refill as it is located at the top of container 12", does not provide a reservoir thereabove and blocks the use of a funnel thereabove. Moreover, container 14" cannot be used with disinfectant containers 12" which do not have support surface 110" and therefore the third embodiment requires refills which encourage proper disposal.

In any of the three embodiments above, it is contemplated that containers 12, 12' and 12" will be replaceable/disposable and that assemblies 14, 14' 14", 16 and 16' will be reusable (or alternatively also replaceable). In addition, it is also contemplated that valve 28 may be reusable. Thus, containers 12, 12' and 12" might be sold with disinfectant therein and simply attached to assemblies 14, 14' and 14", respectively.

What has been described above are preferred embodiments of the present invention. Other embodiments are also within the intended scope of the claims. For example, the containers 12, 12', 12" may not be cylindrical. They may be square or have other configurations. In addition, while use of a separate seal below the brush support is preferred it is not required (e.g. the support itself can have a lower rubber surface). Moreover, the bellows 26' in the second embodiment (FIG. 8) may be provided in an upper portion of wall 20' below edge 24' or, for that matter, may be provided by assembly 14' between ledge 84' and section 82'.

Other methods of sealing the brush support wall 88 to the container are also within the scope of the invention. For example, an O-ring can be positioned between a radially outward side of a skirt that depends from the support wall and the container. Alternatively, the support wall could have a wiper seal depending from it that abuts against the container. Moreover, a form of screw on assembly that provides a seal could be used. As such, the claims which follow should be looked to in order to judge the full scope of the invention.

We claim:

1. A brush and storage container system, comprising:

a container having a bottom member, a wall extending up from the bottom member to a support edge, the wall having a resilient vertical compressible portion, the floor member and wall together defining a cavity having upper and lower volumes with the lower volume suitable to stock a fluid; and a brush assembly having an upper handle, a support extension below the upper handle, and a lower brush portion;

wherein with the brush portion inserted in the cavity and the support extension resting on the support edge, downward vertical movement of the support extension compresses the vertical portion and reduces at least one of the upper or lower volumes from an original volume.

2. The system of claim 1 wherein the vertical portion is a bellows and the support extension is a radially extending extension.

3. The system of claim 2 wherein the upper and lower volumes are separated by a valve such that when fluid is placed in the lower volume and the vertical portion is compressed, a portion of the fluid is forced past the valve into the upper volume.

4. The system of claim 3 wherein the valve allows a first flow rate from the lower to the upper volume during such a compression, and a second flow rate from the upper to the lower volume after compression wherein the second flow rate is less than the first flow rate.

5. The system of claim 4, wherein the valve forms an opening between the upper and lower volumes and includes a gasket having top and bottom surfaces, the gasket being mounted with its top surface facing the upper volume and its bottom surface facing the lower volume.

6. The system of claim 1, wherein the lower volume forms part of a bottle which is separable from the upper volume.

7. The system of claim 6, wherein the upper volume forms a first throat and a valve seat therein at a lower end and the lower volume forms a second throat at an upper end, the lower volume including a radially inwardly extending member forming a support surface essentially within the second throat, the system including a gasket having a blocker and a supporter leg, the blocker having upper and lower surfaces, the supporter leg extending from the lower surface and having a distal end, the gasket being mounted inside the first throat with its top surface facing the upper volume and for movement therein between a blocking position with the blocker on the seat and a valve position above the seat, wherein, when the first and second throats are linked to each other, the support surface contacts the distal end and supports the gasket in the valve position.

8. The system of claim 1, wherein the brush assembly is a toilet bowl brush.

9. A container for use in a brush and storage container system, the container comprising:

a bottle having a bottom member, a wall extending up from the bottom member to a support edge, the wall having a resilient vertical compressible portion, the floor member and wall together defining a cavity having upper and lower volumes with the lower volume suitable to stock a fluid, and the lower volume being separable from the upper volume;

a throat that defines an inlet of the lower volume;

a web inserted in the inlet, the web having a central support area, and an apertured region around the support area; and attachment means linking a radially outer periphery of the web and the inlet so as to retain the web in the inlet.

10. The container of claim 9, wherein the attachment means is a recess and projection connection.

11. The container of claim 10, wherein the attachment means is a groove formed along the inlet and a flange formed on the radially outer periphery of the web.

12. The container of claim 11, wherein the flange snap fits in the groove.

13. The container of claim 9, wherein the web blocks at least 70% of the cross sectional area of the bottle inlet.

* * * * *